United States Patent [19]

Schubeck

[11] 3,943,206

[45] Mar. 9, 1976

[54] CARBURETOR TEMPERATURE RESPONSIVE THROTTLE PLATE POSITIONER

[75] Inventor: Phillip A. Schubeck, Woodhaven, Mich.

[73] Assignee: Ford Motor Company, Dearborn, Mich.

[22] Filed: July 14, 1975

[21] Appl. No.: 595,660

Related U.S. Application Data

[63] Continuation of Ser. No. 424,134, Dec. 12, 1973, abandoned.

[52] U.S. Cl. ..... 261/39 B; 261/50 A; 261/65

[51] Int. Cl.[2] ..... F02M 1/10

[58] Field of Search ..... 261/50 A, 39 A–39 E, 261/65

[56] References Cited

UNITED STATES PATENTS

| | | | |
|---|---|---|---|
| 2,102,428 | 12/1937 | Macauley, Jr. et al. | 261/39 B X |
| 2,633,342 | 3/1953 | Baker | 261/52 |
| 2,747,848 | 5/1956 | Kehoe | 261/65 X |
| 3,642,256 | 2/1972 | Phelps | 261/39 D |
| 3,760,785 | 9/1973 | Harrison et al. | 261/65 X |
| 3,831,909 | 8/1974 | Freismuth | 261/39 A |

FOREIGN PATENTS OR APPLICATIONS

| | | | |
|---|---|---|---|
| 807,242 | 1/1959 | United Kingdom | 261/39 B |

*Primary Examiner*—Tim R. Miles
*Assistant Examiner*—William Cuchlinski, Jr.
*Attorney, Agent, or Firm*—Robert E. McCollum; Keith L. Zerschling

[57] ABSTRACT

The carburetor has a fast idle cam that is rotated by a temperature responsive element to progressively present steps of differing radial extent into the path of closing movement of the carburetor throttle plate, during cold weather operation, to maintain the throttle plates open beyond the normal idle speed position. As the temperature increases, the cam is rotated to decrease the throttle plate opening in proportion. During cold starts, an insert is positioned against the cam to open the throttle plates wider, regardless of the rotative position of the cam, for more air and fuel flow to start. Once started, the insert is removed by a vacuum servo, and the throttle plates permitted to assume the open position dictated by the cam step engaged.

1 Claim, 10 Drawing Figures

CARBURETOR TEMPERATURE RESPONSIVE THROTTLE PLATE POSITIONER

This is a continuation of application Ser. No. 424,134, filed Dec. 12, 1973, now abandoned.

This invention relates in general to a carburetor for a motor vehicle. More particularly, it relates to a carburetor that automatically provides more than just the one high cam engine starting position normally found on the conventional fast idle cam.

Most commercial motor vehicle carburetors equipped with cold enrichment systems include a fast idle cam. The cam is usually moved by a thermostatically responsive coiled spring to project more and more into the path of closing movement of the throttle plate shaft as the temperature becomes colder to provide richer than normal air/fuel mixtures for cold engine operation. The cam usually has a high cam step for the coldest engine starting, followed sequentially, for progressive engagement as the temperature increases, by a number of lesser projecting steps.

In the conventional carburetor having an air movable choke plate, the plate usually is positioned essentially closed for cold engine starts. This lessens airflow and increases the vacuum fuel metering signal to draw in enough extra fuel to provide sufficient vapor for starting the engine. Once the engine fires, however, the throttle plates must be open enough to permit the engine to draw in enough fuel and air to raise the engine cranking speed of say 100 r.p.m. to say 1000 r.p.m. fast idle speed sustaining engine operation. Once the engine running operation is attained, then the overrich starting mixture no longer is required, and it becomes desirable to reduce the throttle plate openings to a lower setting, but still one that is richer than that which provides the normal idle speed when the engine has warmed up.

The position of the throttle valve, therefore, is important. The more it is cracked open from the closed position during engine cranking operations, the greater the volume of air and fuel inducted. Therefore, for engine starts, the throttle valve stop is scheduled to be located against the high step of the fast idle cam to provide the richest cranking air/fuel mixture.

As stated above, the conventional carburetor choke mechanism provides a single high cam step position for all cold starting purposes whether the temperature is 80°F. or −20°F., with a number of lower steps to be progressively engaged as the engine warms, to gradually decrease the engine speed to a normal idle setting. Obviously, there is some temperature level when the degree of throttle opening provided by the high cam step provides the best rich air/fuel mixture. Off this setting in either direction, the mixture is generally not rich enough or too rich.

Accordingly, it is an object of this invention to provide a throttle plate positioner that automatically provides a variable number of high cam positions for engine starting purposes.

It is another object of the invention to provide a throttle plate positioner that provides additional throttle plate openings during cold starting operations that vary as a function of the position of the fast idle cam.

Another object of the invention is to provide a throttle plate positioner that includes a stop secured for rotation with the throttle plate and engagable with one of a number of steps formed on the edge of a fast idle cam rotatable by a temperature responsive means, the fast idle cam having other means associated with it to provide additional throttle plate openings during cold engine starts over that provided by the steps normally engaged, the additional throttle plate openings being terminated once the engine has attained running operation.

It is another object of the invention to provide a throttle valve positioner of the type described above in which the other means associated with the fast idle cam is a member that is insertable between the throttle stop and the fast idle cam steps during starting operations to open the throttle plates wider at this time, the member being withdrawn once the engine has attained running operation.

It is still further object of the invention to provide a throttle plate positioner as described above in which a pivotally movable finger-like portion is spring urged into position between the throttle stop and cam step during engine-off operation once the throttle plate has been opened preparatory to engine starting, and a servo operated by manifold vacuum withdraws the finger portion after the engine has started to permit normal throttle plate positioning as a function of a conventional fast idle cam stepped face construction.

Other objects, features and advantages of the invention will become more apparent upon reference to the succeeding detailed description thereof, and to the drawings illustrating the preferred embodiments thereof, wherein.

Figure 1:
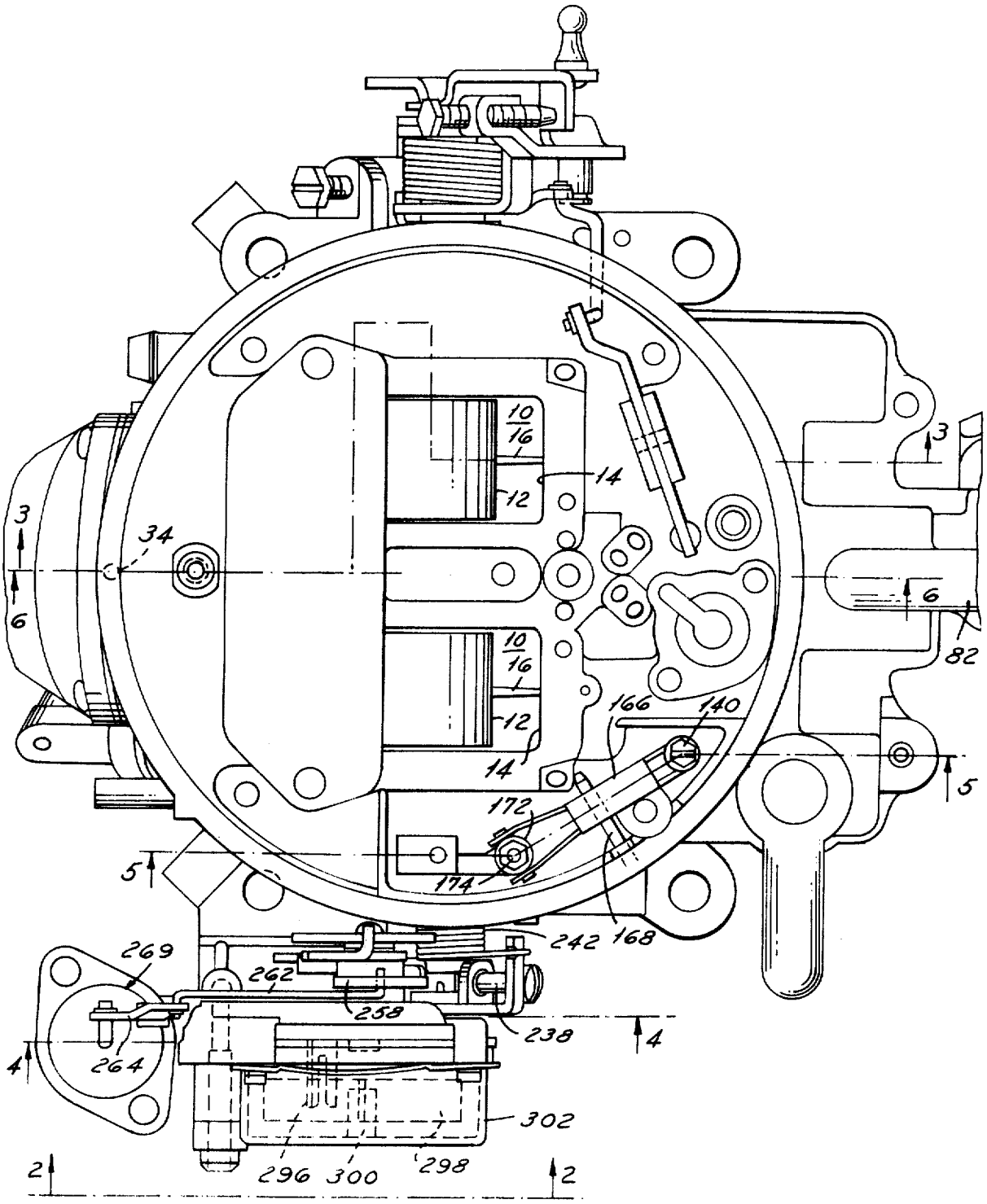
FIG. 1 is a plan view of a variable area venturi type carburetor embodying the invention.
Figure 4:
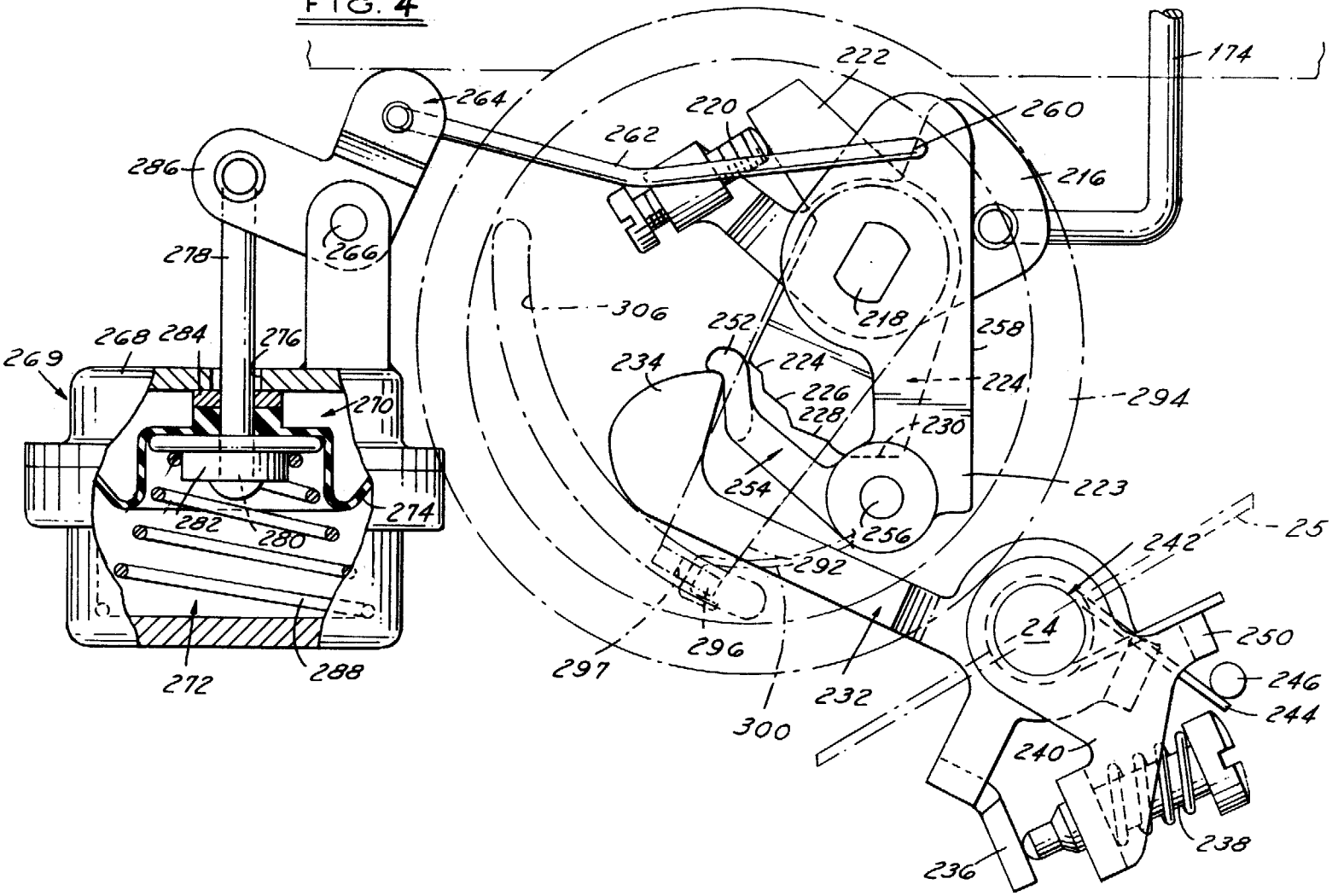
Figure 5:
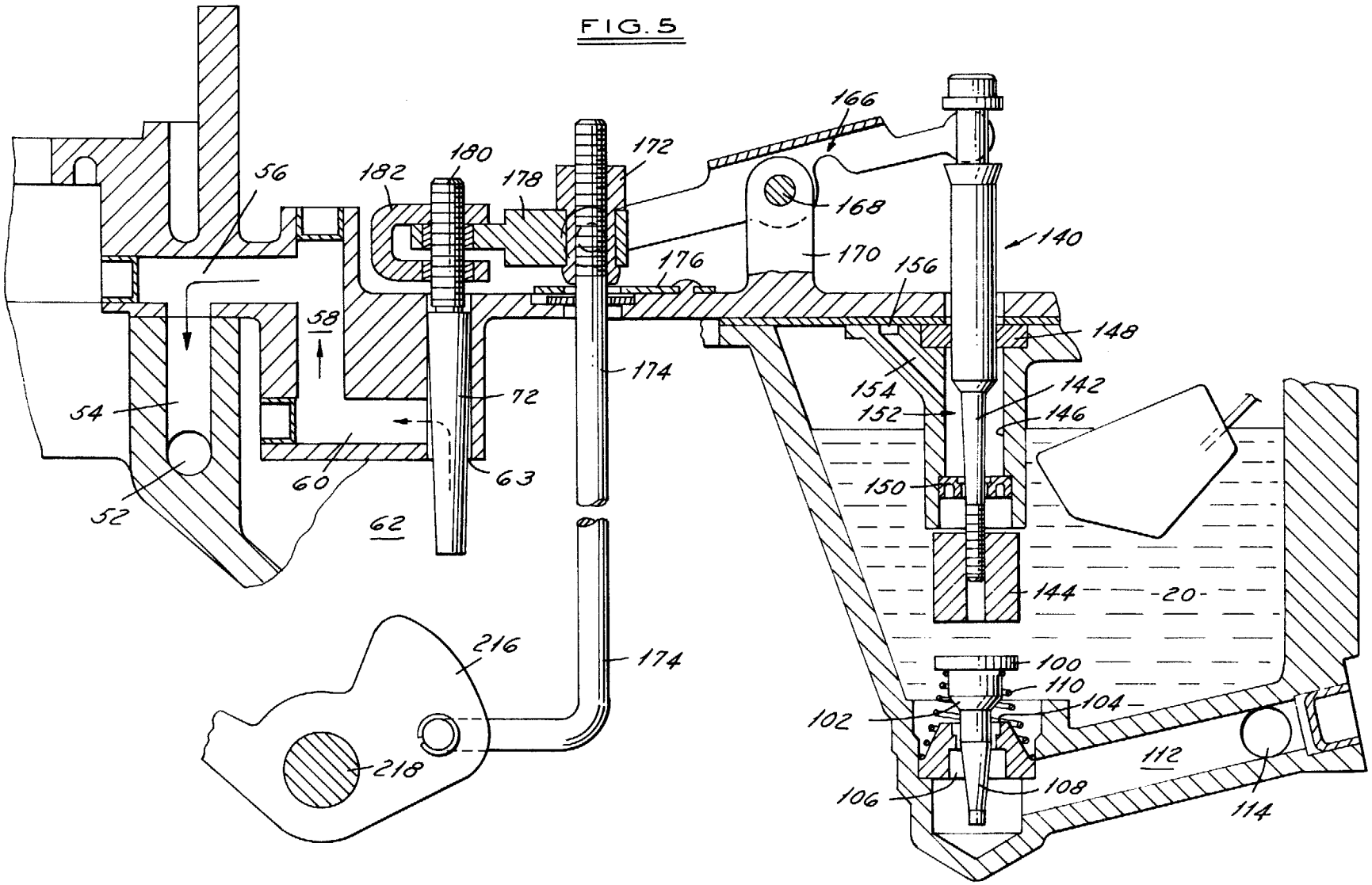
Figure 6:
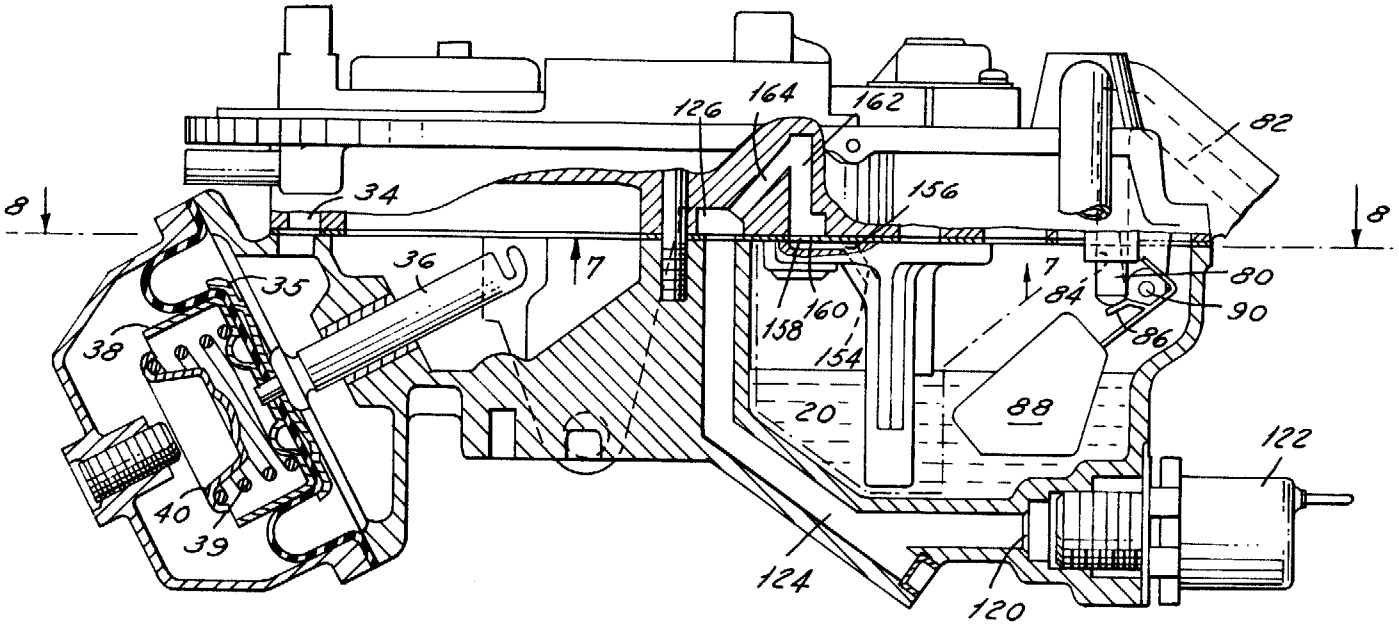
Figure 10:
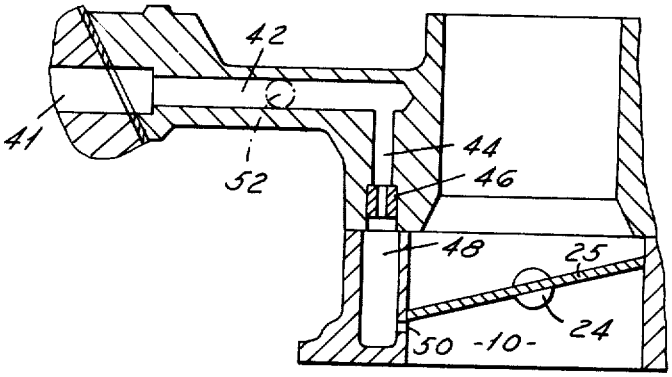
Figure 9:
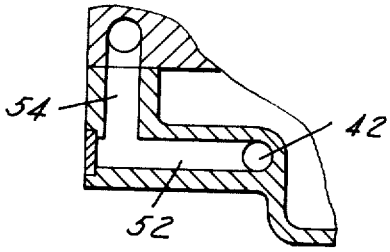
Figure 7:
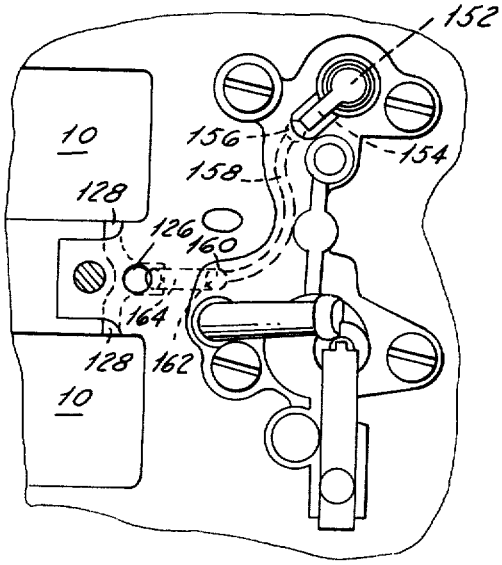
Figure 8:
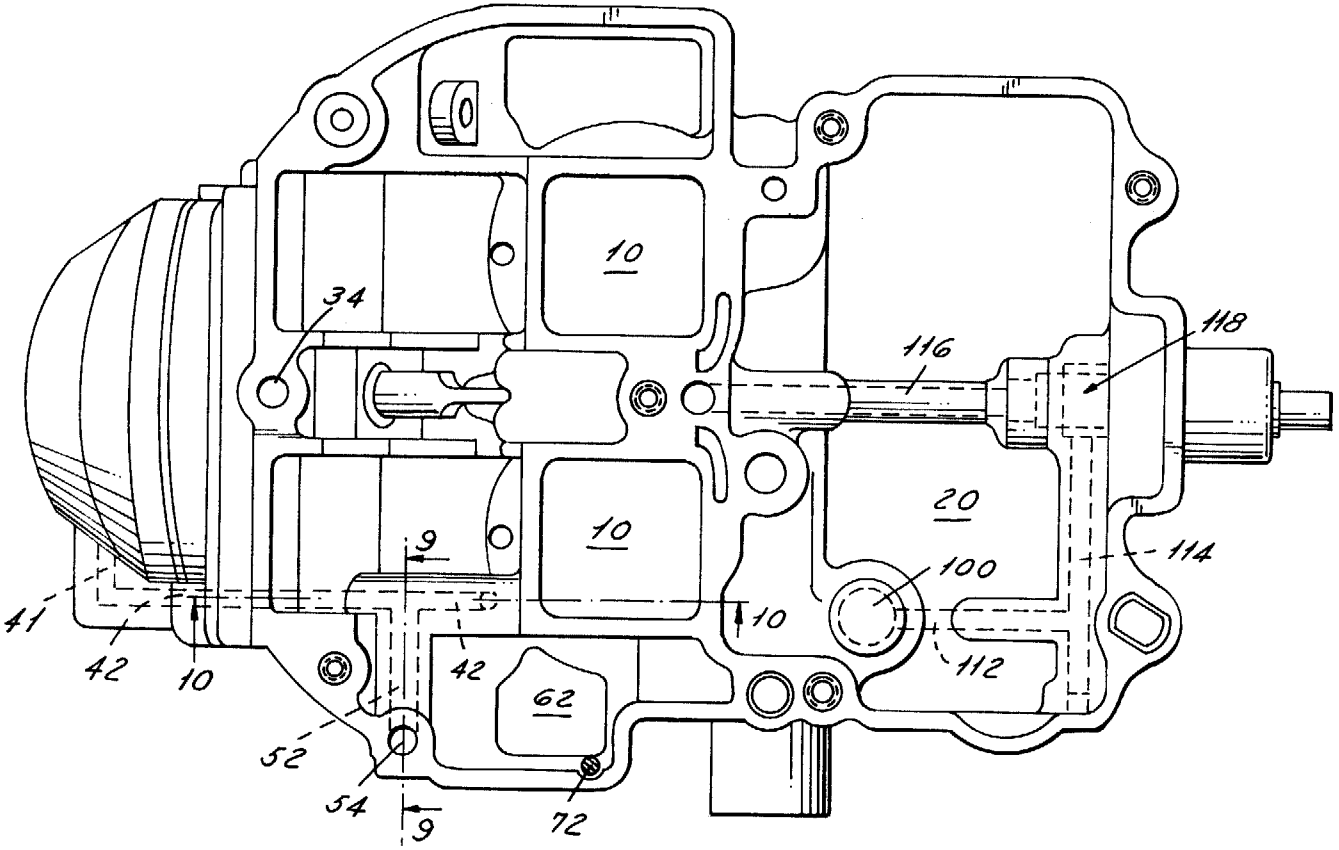

FIGS. 4 and 5 are enlarged cross sectional views taken on planes indicated by and viewed in the direction of the arrows 4—4 and 5—5 of FIG. 1;

FIG. 6 is a cross sectional view taken on a plane indicated by and viewed in the direction of the arrows 6—6 of FIG. 1;

FIG. 7 is a bottom view taken on a plane indicated by and viewed in the direction of the arrows 7—7 of FIG. 6, and looking up at the underside portion of the air horn portion of the carburetor;

FIG. 8 is a cross sectional view taken on a plane indicated by and viewed in the direction of the arrows 8—8 of FIG. 6 and looking down on the main or central body portion of the carburetor; and, FIGS. 9 and 10 are cross sectional views taken on planes indicated and viewed in the direction of the arrows 9—9 and 10—10 of FIG. 8.

FIG. 1, which is essentially to scale, is a plan view of a variable area venturi carburetor of the downdraft type. It has a pair of rectangularly shaped induction passages 10, each having one end wall 12 which is pivotally movable and has the profile (FIG. 3) of one-half of a venturi 13. Each opposite fixed cooperating wall 14 is formed with the mating profile of a portion of a venturi. The airflow capacity, therefore, varies in proportion to the opening movement of walls 12 of the induction passages.

Figure 3:
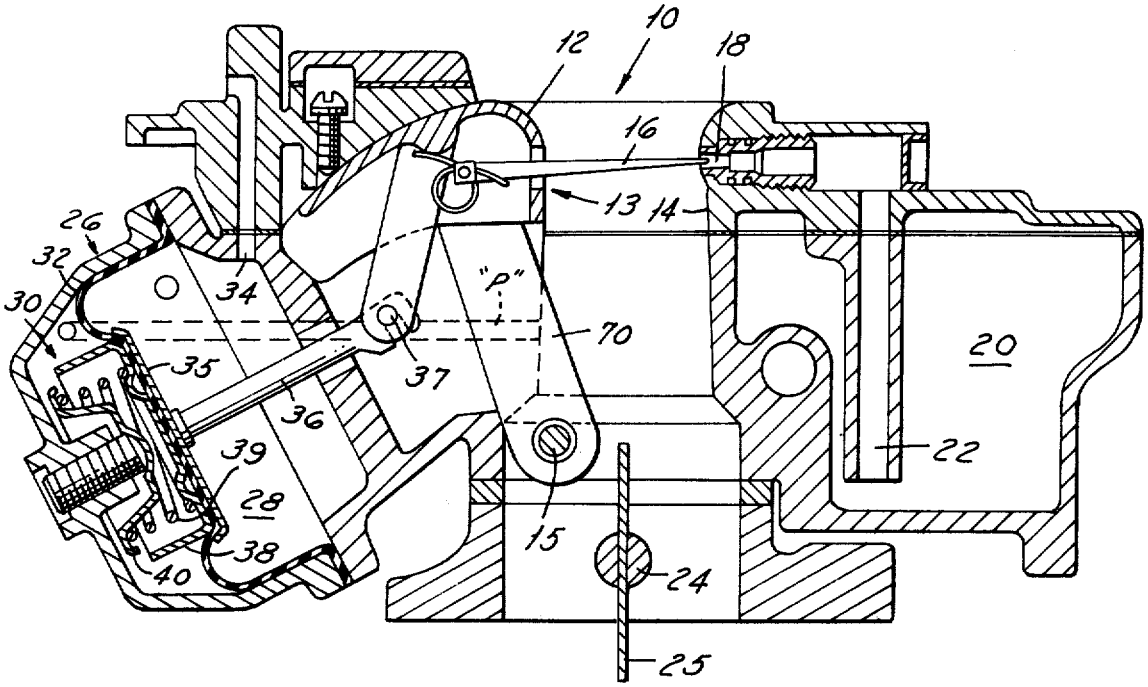
FIG. 3 is a cross sectional view taken on a plane indicated by and viewed in the direction of the arrows 3—3 of FIG. 1.

As seen more clearly in FIG. 3, movable walls 12 are pivotally mounted at 15 on a stationary pin. The pin actually is fixed to a strut, not shown, that depends from a section of the air horn or upper body portion of the carburetor. Pivotally attached to each of the wall bodies is a fuel metering rod or needle 16 that is tapered for cooperation with a main fuel metering jet 18. The needles have a controlled taper to provide a richer air/fuel mixture at the smaller venturi areas. Each jet is located in an aperture inside wall 14 at approximately the throat or most constricted section of venturi 13. A fuel float bowl or reservoir 20 has a pair of identical passages 22 conducting fuel to the main metering jets 18. Downstream of the venturiis, the carburetor throttle body portion 23 rotatably mounts a shaft 24 on which are fixed a pair (only one shown) of conventional throttle plates 25 that control the flow of air and fuel through induction passages 10.

The size of venturiis 13 and the movement of walls 12 is controlled in this case by a spring returned, control vacuum actuated, diaphragm type servo 26. The servo consists of a hollow two-piece casting divided into two chambers 28 and 30 by an annular flexible diaphragm 32. The diaphragm is sealingly mounted along its edge in the casting. Chamber 28 is an air chamber, connected to ambient or atmospheric pressure through a passage 34 (indicated also in FIGs. 1, 6 and 8). Chamber 30 is a vacuum chamber connected to induction passages 10 at a point below the throat but still in the venturi 13. This subjects chamber 30 to changes in a control vacuum that varies with airflow but at a rate that is slightly different than true venturi vacuum. The exact location of the tap of course is a matter of choice. Chamber 30 also is connected to be actuated by ported intake manifold vacuum, for cold weather operation, as will be described in more detail later.

Completing the construction, servo 26 has fixed to one side of diaphragm 32, by a retainer 35, a plunger or actuator 36. The plunger is pivotally connected to a shaft 37 interconnecting cast portions of the movable walls 12. Fixed to the other side of diaphragm 32 is a retainer 38 against which is seated a spring 39. The other end of the spring bears against a seat 40 axially adjustable to vary the spring preload.

FIG. 3 indicates schematically in dotted lines a passage *p* between chamber 30 and induction passages 10. In actuality, as best seen in FIGS. 5, 8, 9 and 10, servo chamber 30 is connected by a restricted line 41 (FIG. 8) to an intersecting passage 42 (FIGS. 8–10). Passage 42 intersects with a vertically downwardly extending passage 44 (FIG. 10) containing a flow restrictor or orifice 46 and terminating in a chamber 48. Chamber 48 is connected by a port 50 to the induction passage 10 at a point below the edge of throttle valve 25 when it is in its closed position shown. In the position shown, therefore, as the throttle valve is rotated to an open position, port 50 is progressively subjected to the increased pressure above the throttle valve to bleed the vacuum in passage 42.

Passage 42 also intersects with a right angled passage 52 (FIGS. 8, 9 and 5) that connects to a passage 54 (FIG. 5). The latter passes vertically through the main body portion of the carburetor air horn section. Passage 56 in turn is connected by a pair of passages 58 and 60 to the well 62 (FIG. 8) in which is arcuately movable one of the mounting members 70 (FIG. 3) for movable wall 12. While not shown, the well 62 in FIG. 8 and the adjacent induction passage 10 are interconnected by a depressed portion of the main body between the two so that the opening or port 63 shown in FIG. 5 senses the control or venturi-like vacuum connected by the passages named to servo chamber 30.

Looking now at FIG. 5, the opening 63 to the control vacuum in this case is adapted to be alternately blocked or progressively opened by a needle type valve 72. The valve is movable into and out of the seat 63 in response to a temperature sensitive element, in a manner that will be described more clearly later. Suffice it to say at this point, that during normal engine operating temperatures, the needle valve 72 is completely withdrawn from opening 63 thereby permitting venturi-like vacuum to be sensed through passages 60, 58, 56, 54, 52, 42 and 41 to chamber 30 of the servo, the ported manifold vacuum simultaneously being sensed through port 50, chamber 48, line 42 to line 41 and servo chamber 30.

It should be noted that the size of the venturi-like vacuum passages 60, 58, 56, 54 and 52 are considerably larger than that of the ported manifold vacuum passage 44, coupled with the orifice 46, so that when the needle valve 72 is in the up position, the manifold vacuum is bled to the level of the venturi-like or control vacuum and, therefore, has essentially no effect on the movement of servo 26. The manifold vacuum is used during cold weather operations to modulate the venturi-like or control vacuum to schedule the opening of the venturi 13 to increase the richness of the fuel/air mixture. When the needle valve 72 is in the closed or nearly closed position, the venturi vacuum flow will be blocked and manifold vacuum will be at its true value acting on servo chamber 30. This will cause the movable venturi walls 12 to be moved to a larger area venturi to pull the fuel metering rods 16 out further and thereby provide a richer setting fuel flow.

As thus far described, during normal engine operating temperatures, the operation is as follows. The rotative movement of throttle valves 25 controls total airflow through both passages 10 to increase as the throttle valves are moved from their closed position. An increase in airflow provides essentially a proportional increase in the control vacuum in chamber 30 from port 63 until the diaphragm 32 is moved towards the cup 40. This moves both walls 12 to open induction passages 10 and increase the area of venturiis 13 while simultaneously retracting the fuel metering rods 16 to increase fuel flow. Thus, the total airflow and fuel flow vary with changes in throttle valve setting up to a maxium.

Returning now to the general construction shown in FIG. 1, during cold weather operation, as stated previously it is desirable to provide an additional supply of fuel to the induction passages to assure sufficient fuel vapor both for starting the engine as well as a different schedule of additional fuel for running the cold engine prior to its reaching normal operating temperature level. This is satisfied by the provision of a combination fuel enrichment system, a cranking fuel enrichment system, as well as a throttle plate positioner device constructed according to the invention to crack open the throttle plates an additional amount during cold starting operations.

More specifically, FIGS. 5, 6 and 8 show portions of both the cold running enrichment system as well as the cold start cranking fuel system. The body portion of the carburetor is cast with a fuel bowl 20 containing fuel delivered thereto past a conventional inlet needle valve 80 from a supply line 82. The needle valve 80 is moved vertically in a bore 84 by the tab 86 secured to a float member 88 pivotally mounted at 90 on a depending portion of the air horn section of the carburetor.

The inlet valve 80 operates in a known manner. Movement of float 88 downwardly as a result of lowering of the liquid fuel level causes the needle 80 to drop. This permits fuel under pressure to enter the reservoir from line 82 to fill it again to the desired level. Raising of the float raises the inlet valve against the conical seat shown to shut off the supply when the desired level has been reached.

The lower portion of fuel bowl 20 contains a spring opened cranking fuel supply valve 100 (FIG. 5). The latter has a conical valve portion 102 that cooperates with an annular knife edge seat 104 located in the end of a fuel passage 106. Valve 100 has a tapered stem portion 108 and is biased upwardly by a spring 110 to open passage 106 to the flow of fuel from bowl 20. An intersecting passage 112 (FIG. 8) connects with a cross passage 114 to flow fuel into another passage 116 past a solenoid controlled valve unit 118.

As best seen in FIG. 6, unit 118 consists essentially of a valve 120 formed on the end of the armature of a solenoid 122. A spring not shown normally biases valve 120 to close communication between passages 114 and 116. The solenoid normally would be powered from the starter relay of the motor vehicle ignition system so that the solenoid is rendered operative only during engine starting conditions. That is, when the ignition key is turned to the start position, the solenoid 122 would be energized and cause valve 120 to be retracted rightwardly to open communication between passages 114 and 116. A flow of starting fuel would then be permitted from fuel bowl 20 to passage 116.

As soon as the engine attained running condition, return of the ignition switch to the on position would de-energize solenoid 122 and again block passage 114 from communicating with passage 116. The solenoid unit could include a manifold vacuum switch so the solenoid is not energized above a vacuum level of say 2 inches Hg., for example. It also could contain a thermal switch to prevent operation above 80°F., for example, when extra cranking fuel usually is not needed.

From passage 114 the fuel passes upwardly through the carburetor main body passage 124 (FIG. 6) where it flows into a plenum 126, shown also in FIG. 7. From the plenum, the fuel is divided equally to be inducted out through passages 128 into each of the induction passages 10 at a location adjacent the venturi but spaced from the fuel jets 18. Thus, it will be seen that for starting operations, energization of the solenoid by turning of the vehicle ignition switch causes additional fuel to be added at times to the induction passages, for starting purposes.

The quantity of cranking fuel to be added to the induction passages, or, on the other hand, the position of cranking valve 100, is controlled by the lower end of a needle valve 140 (FIG. 5) that forms a portion of the engine running fuel enrichment system. More specifically, needle valve 140 is tapered at its lower end as shown at 142 and has threaded to it an abutment portion 144. The latter is adapted to engage the cranking valve 100 when the needle valve is moved downwardly during warmer than the coldest weather operations. The screw connection of member 144 to the needle valve provides axial adjustment for varying the characteristics of the fuel flow.

The needle valve 140, in this case, is vertically movable in a well 146 in the upper body portion and is axially aligned by a pair of seals 148 and 150. The seals define a chamber 152 which is connected by an angled passage 154 to the end 156 of a worm-like passage 158 best seen in FIG. 7. The opposite end 160 of passage 158 connects with a vertical passage 162 (FIG. 6) that intersects an angled passage 164 leading to the plenum 126. As stated previously, plenum 126 also receives fuel from the cranking fuel passage 124. Together then, the fuel passes into each induction passage 10 through the side passages 128. It will be seen then that, depending upon the vertical position of needle valve 140, a quantity of fuel will flow past the tapered portion 142 of the needle valve into the various passages into induction passages 10 to supply additional fuel during cold running operation of the engine.

The vertical movement of needle valve 140 is controlled by a temperature sensitive element that moves the needle valve 140 upwardly to increase fuel flow as the temperature decreases below the normal operating level, and moves the needle valve 140 to a downward position to shut off the fuel enrichment when the temperature reaches the normal operating level. Concurrently, the downward movement of needle valve 140 as the temperature increases will move the cranking fuel valve 100 downwardly against the force of spring 110 in proportion to the temperature increase. Therefore, when the normal operating level is reached, cranking valve 100 will be completely closed against seat 102 and no additional fuel will then be added during starting of the engine.

The upper end of needle valve 140 is pivotally connected to the end of a lever 166. The lever is pivotally mounted on a pin 168 projecting through an aperture in a boss 170 projecting from the carburetor upper body. The opposite end of lever 166 is pivotally connected to an adjustable nut 172 on the upper end of a depending link 174. The link 174 is adapted to be connected to a thermostatically responsive movable element to be described. Adjusting the upper end 174 of course will vary the operating characteristics of the system. Downward movement of link 174 is limited by abutment of the nut 172 against a stop washer 176. Projecting horizontally or laterally from link 174 is a connector 178 pivotally engaging the threaded upper end 180 of needle valve 72. The upper end 180 contains a yoke member 182 adjustably threaded to the end of needle valve 72 as shown to determine the upward and downward limits of movement of the needle valve.

As thus far described, therefore, with respect to the running fuel enrichment system, when link 174 is in the position shown indicating that the temperature is at the lowest below normal engine operating level, the needle valve 140 will have been moved to its upwardmost position to provide maximum fuel flow, and the needle valve 72 will have moved to its downwardmost position to block the port or outlet 63 to the induction passage shown in FIG. 8. Thus, essentially the full value of ported manifold vacuum in port 50 (FIG. 10) will act in the servo chamber 30 to move walls 12 to enlarge the venturi areas, which decreases the fuel metering signal, but increases the fuel flow by withdrawing the metering rods 16 to richer settings.

Simultaneously, maximum additional fuel quantity will flow from the fuel enrichment well 152 into the induction passages 10 through the interconnecting outlet passages 128. As soon as the temperature increases from its lowest setting, the link 174 will move vertically upwardly from the position shown. This will gradually and progressively raise the venturi-like vacuum control needle valve 72 and lower progressively the needle valve 140. Thus, the venturi-like control vacuum begins to bleed into passage 60. The vacuum force acting on servo chamber 30 will progressively decrease to permit servo spring 46 to slowly close the venturi towards the normal engine idle speed position. The additional fuel enrichment will decrease as the tapered portion 142 of needle valve 140 closes the opening to the fuel bowl.

Figure 2:
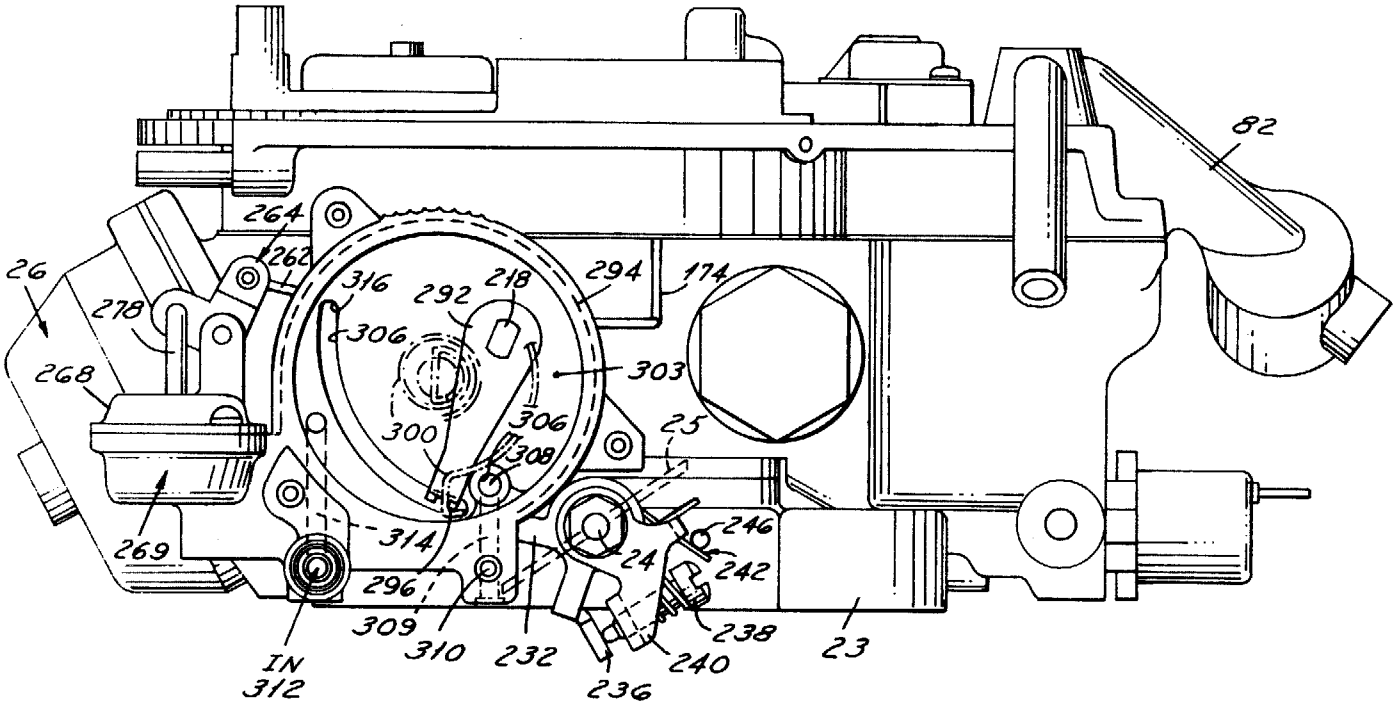
FIG. 2 is a side elevational view taken on a plane indicated by and viewed in the direction of the arrows 2—2 of FIG. 1.

Turning now to the temperature responsive control of the movement of link 174 and the throttle valve positioner, FIGS. 1, 2 and 4 show the same more clearly. As best seen in FIG. 4, the lower end of link 174 is pivotally connected to one end of a lever 216 that is fixed on a shaft 218. The other end of lever 216 adjustably supports a screw 220 that bears against the end 222 of an essentially conventional fast idle cam 224. The cam is rotatably mounted on shaft 218 and has a weighted lower end 223. The end has a peripheral edge portion formed with a series of circumferentially contiguous steps 224, 226 and 228 and a high cam step 230. Each step progressively in the order named is of greater radial extend than the previous.

Cooperating with fast idle cam 224 to locate or position the throttle plates 25 is a lever or throttle stop 232 formed at its outer end with a curved engaging portion 234. Lever 232 is rotatably mounted on throttle shaft 24. It has a depending tang portion 236 engaged by the end of an adjustably mounted screw 238 carried by a linkage 240 fixed to the throttle shaft 24. A throttle return coil spring 242 has one end 244 anchored under a pin 246 extending from a fixed portion of the carburetor throttle flange. The opposite end of the spring bears against an angled tang 250 of linkage 240 thereby biasing the linkage and screw 238 in a clockwise direction against the tab end 236 of lever 232. The lever 232 thus is constantly biased in a clockwise direction towards the edge surface of fast idle cam 224. The cam steps therefore constitute abutment means or stops in the path of movement of lever 232 to determine the idle speed position of throttle plates 25.

Insertable at times between the end 234 of lever 232 and the edge of fast idle cam 224 is the finger portion 252 of an arcuately movable link 254. The latter is pivotally connected at 256 to the end of a lever 258 rotatably mounted on shaft 218. Lever 258 is connected at its upper end at 260 to an actuating link 262. The opposite end of link 262 is connected to one end of a bell crank lever 264 pivotally mounted at 266 on the ears of an extension of a servo housing 268.

The servo housing is hollow and divided into two chambers 270 and 272 by an edge mounted annular flexible diaphragm 274. Chamber 270 is an air chamber communicating to the atmosphere through an opening 276. Chamber 272 is a vacuum chamber communicating by a passage not shown with the induction passages at a location below the throttle valves 25. A plunger 278 is riveted at one end 280 to a hat shaped spring retainer 282, and projects through a stop 284 for connection to the opposite end 286 of bell crank lever 264. A compression spring 288 normally biases the plunger 278 upwardly to move bell crank 264, link 262, lever 258 and finger portion 254 in a clockwise direction.

Application of engine vacuum to the servo chamber 272 when the engine is running is sufficient to counteract the force of spring 288 and cause the plunger 278 to move vertically downwardly. This moves lever 258 and finger portion 254 in a counterclockwise direction to withdraw or retract the finger portion from between the lever end 234 and the fast idle cam steps.

Thus, it will be seen that when the engine is off preparatory to starting operation, depression of the vehicle accelerator pedal will rotate throttle shaft 24 and lever 232 in a counterclockwise direction away from the end 252 of finger portion 254. Since there is no manifold vacuum in chamber 272 of servo 269, spring 288 will position the finger portion 254 to the position shown so that upon release of the accelerator pedal, coil spring 242 will cause a clockwise return movement of the throttle valve lever 232 until it engages the arcuate portion 290 of the end 252 of the finger portion 254, which in turn abuts the edge of the fast idle cam 224.

Once the engine has attained running operation beyond cranking vacuum level, then opening of the throttle valves 25 by depression of the accelerator pedal, pivots lever 232 downwardly and permits retraction or movement of finger portion 254 to an inoperative position to the right by the vacuum in servo 269. Lever 232 then is permitted to engage the edge of the fast idle cam directly and the position of the throttle plates will be determined strictly by the rotative position of the fast idle cam 224.

The fast idle cam is controlled in its rotation by a lever 292 fixed on shaft 218. The lever is located within a hollow cup-shaped housing 294 that is cast integrally with the throttle body portion 23. Lever 292 has an upturned slotted end 296 in which is located the outer end 297 of a thermostatically responsive bimetallic spring coil 298. The inner end of the spring is fixed on a stub shaft 300 projecting from an insulated cover 302. The cover is fastened by screws to the housing 294 with an insulating gasket 303 between. The gasket has an arcuate slot 304 along which the end 296 moves with temperature changes. The gasket also has a hole 306 through which projects the end 308 of a tube connected by a pair of passages 309 and 310 to the induction passages 10 at a location (not shown) below the throttle valves. For clarity, the cover 302 has been removed in FIG. 2, and FIG. 4 shows the outline of the housing in phantom, for orientation purposes. Completing the construction, the housing has a hot air inlet tube 312 connected by a passage 314 to the interior of housing 294 on the far side of gasket 302. The tube would emanate from a known type of exhaust manifold heated stove in which air flowing past the manifold is warmed.

In operation, once the engine is operating, with gasket 303 in place and cover 302 applied, manifold vacuum acting in passages 309 and 310 causes hot air to flow into tube 312 to the far side of gasket 303. The air is then drawn through the slot 304 and out through passages 309 and 310, warming the coil 298 as it passes it. Thus, the coil will be progressively warmed as the engine temperature rises, resulting in a circumferential movement of the end 297 of the coil to rotate lever 292 in the same direction. This rotates lever 216 away from the fast idle cam and permits the fast idle cam to rotate counterclockwise by gravity. Similarly, cooling of the coil will cause it to rotate levers 292 and 216 in the opposite direction. This of course simultaneously rotates the fast idle cam 224 by the screws 220, so that, depending upon the temperature level, one of the steps 224, 226, 228 or the high cam step 230 will be presented opposite the end 234 of throttle lever 232. Thus, the throttle plate idle speed setting will be determined by which step is engaged by lever 232, during running operations of the engine. During cold start operations, as described previously, the finger portion 254 will be inserted between the end 234 of lever 232 and whatever step or rotative cam position the fast idle cam 224 has attained so that the throttle plates are opened more for starting purposes than during normal cold running conditions.

It will be seen, therefore, that regardless of what position the fast idle cam 224 assumes because of the prevailing ambient temperature, the throttle plates will be opened an additional amount for starting purposes. The additional amount will vary to agree with the ambient temperature level so that a correct starting air/fuel mixture is obtained. This is in contrast to the conventional constructions in which there is only one fast idle start position, accomplished only by positioning the single high step 230 against the throttle lever end 234. At the inbetween temperature levels, this is too high and results in too fast an idle speed, and one that may provide undesirable emissions.

The overall operation of the carburetor is believed to be clear from the above description and by reference to the drawings. Therefore, it will be repeated now only briefly. Assume that the engine is off and the ambient temperature is essentially 0°F. The coiled bimetallic spring 298 will have contracted a maximum amount rotating lever 292 clockwise from the position shown in FIG. 2 to position the end 297 of the lever at the left end 316 of the slot 304. This will rotate lever 216 to move the fast idle cam 224 clockwise to locate the high cam step 230 opposite the end 234 of throttle lever 232. Simultaneously, by opening the throttle plates, lever 232 will move away from the fast idle cam and permit the servo spring 288 to move the finger portion 254 between the fast idle cam step 230 and lever 232. The throttle plates now will be opened a maximum amount for the coldest start positions. The induction passages 10 at this time are at their smallest cross section because the servo spring 46 has moved walls 12 to this position. This, therefore, exposes the main passages to a larger cranking vacuum signal so that the airflow across the fuel metering jets 18 is increased.

Simultaneously, the rotation of lever 216 moves link 174 downwardly to its extreme position until the stop 172 shown in FIG. 5 abuts the washer 176. This pivots needle valve 140 to its uppermost position allowing a maximum amount of fuel past the tapered lower portion from fuel bowl 20. This upward position also permits the upward movement of the cranking valve 100 by the spring 110 to open wide the passage 106 to flow fuel to passage 112. Therefore, when the ignition switch is turned to an on or start position, the solenoid 122 will withdraw the valve 120 to permit fuel to flow from passage 114 to 116.

When the engine is cranked for starting purposes, the cranking vacuum signal is sufficient acting across the induction passage outlets 128 (FIG. 7) to draw fuel up cranking fuel circuit passage 124 into plenum 126. Simultaneously, fuel is drawn past the engine running fuel circuit needle valve 140 into the worm passage 158 (FIG. 7) to plenum chamber 126, where both circuits combine and the fuel inducted to provide the necessary starting richness. Once the engine has been started, release of the ignition switch to the engine running position de-energizes solenoid 122 to then again block the connection between the cranking supply line 114 and the line 116. However, with the link 174 in its downwardmost coldest position, the valve 72 will also be down blocking off port 63. Accordingly, engine running manifold vacuum at its full value will act in servo chamber 30 and draw the walls 12 of the venturiis to open or enlarge the venturi area. This will withdraw the fuel metering rods 16 to richer setting positions scheduling greater fuel flow. Thus, a richer than normal idle but less than cranking mixture is provided at this time by the main fuel metering system, in addition to the needle valve supplemental feed system.

Simultaneously, upon the engine attaining a running condition, the manifold vacuum established in servo chamber 272 will be sufficient, once throttle lever 232 is pivoted counterclockwise to release finger portion 254, to pivot the finger portion out from between the end 234 of lever 232 and the fast idle cam step it abuts. Now the portion 234 will move to directly abut the step of the idle cam 224 and thereby close down the throttle plates to less open positions. This provides less fuel and airflow for cold running operations, which is desired because a less rich air/fuel mixture now is required once the engine has attained its idle speed horsepower.

As the temperature increases, the bimetallic coiled spring 298 will rotate the lever 216 in a counterclockwise direction away from the fast idle cam. The cam then can move in the same direction by gravity when the throttle plates are opened beyond the fast idle position so that the end of lever 234 gradually moves progressively clockwise to permit the progressive closure of the throttle plates. Simultaneously, the counterclockwise rotation of lever 216 effects an upward movement of link 174 to progressively move the needle valve 140 downwardly and thereby progressively close off the additional fuel flow past the valve. This movement also causes an upward movement of needle valve 72 so that the venturi-like vacuum begins to decay and ported manifold vacuum signal acting in servo chamber 30.

Thus, the lowering vacuum signal in pressure chamber 30 will permit the venturi walls 12 to move to contract the venturi area and move the metering rods 16 into the jets 18 to decrease the fuel supply to the induction passages 10. Eventually, therefore, the throttle plates will be returned to their normal idle speed closed positions, the needle valve 72 will be drawn essentially completely out of port 63 so that movement of the venturi walls will be controlled solely by control or venturi-like vacuum changes, and the supplemental fuel needle valve 140 will be moved downwardly to shut off completely the supply of additional fuel to the system. At this time, the cranking valve 100 will be shut so that even if solenoid 122 opens during engine start condition, no additional cranking fuel will be added to the engine when the engine is started at a normal operating temperature level.

From the foregoing, it will be seen that the invention provides a throttle plate positioner to provide additional throttle plate opening during cold engine starts regardless of the fast idle cam position, to provide increased air and fuel flow for cold weather operation, and, therefore, improved emissions.

While the invention has been shown and described in its preferred embodiment, it will be clear to those skilled in the arts to which it pertains that many changes and modifications may be made thereto without departing from the scope of the invention.

I claim:

1. An engine idle speed control for the throttle plate of a carburetor having an induction passage open at one end to air and adapted to be connected at its other end to the intake manifold of an internal combustion engine, and a spring closed throttle plate mounted for rotation across the passage to control flow of air and fuel therethrough, the control including a lever operatively connected to the throttle plate for rotation therewith, a fast idle cam rotatably mounted for cooperation with the lever, the cam having a stepped contoured peripheral surface engaged by the lever during the closing movement of the throttle plate, the surface consisting of a series of circumferentially contiguous stepped faces of progressively changing radial extension with respect to the axis of the cam, the faces being separately engagable with the lever so as to progressively change the closed position of the throttle lever as a function of the rotative position of the cam to thereby control the idle speed positions of the throttle plate as a function of the movement of the cam, a temperature responsive element connected to the fast idle cam and movable in response to the attainment of predetermined temperature levels to rotate the cam, a shaft rotatably mounting a bellcrank-like lever, the latter lever having a finger-like portion pivotably mounted at one end, the portion being swingable to a position between the lever and cam surface during engine off conditions to cam the lever away from the cam surface incrementally to increase the degree of opening of the throttle plate for starting purposes in direct proportion to the increase in throttle opening afforded by the particular cam face that would be engaged by the lever for the prevailing temperature level, spring means acting on said finger-like portion biasing the portion to a position between the lever and cam face, and engine vacuum responsive servo means operable in response to a predetermined engine manifold vacuum level acting thereon to withdraw the movable means against the spring means bias to permit return of the lever against the cam face and return of the throttle plate to a less open position and one that is dictated by the radial extent of the particular face of the cam surface presented for engagement by the lever in accordance with the prevailing temperature level.

* * * * *